United States Patent [19]

Lakowske et al.

[11] Patent Number: 4,662,819

[45] Date of Patent: May 5, 1987

[54] CENTRIFUGAL FAN WITH VARIABLE BLADE PITCH

[75] Inventors: Rodney Lakowske, La Crosse, Wis.; James C. Tischer, La Crescent, Minn.; David H. Eber, La Crosse, Wis.

[73] Assignee: American Standard Inc., New York, N.Y.

[21] Appl. No.: 849,997

[22] Filed: Apr. 10, 1986

[51] Int. Cl.[4] ..... F04D 29/28; F04D 29/36

[52] U.S. Cl. ..... 415/129; 416/186 A; 416/167; 416/168 R

[58] Field of Search ..... 416/186 A, 167, 168 R, 416/168 A; 415/129

[56] References Cited

U.S. PATENT DOCUMENTS

| | | | |
|---|---|---|---|
| 509,143 | 11/1893 | Smith . | |
| 1,180,587 | 4/1916 | Ingram . | |
| 1,451,263 | 4/1923 | Kaplan . | |
| 1,467,672 | 9/1923 | Kaplan . | |
| 1,611,341 | 12/1926 | Deriaz | 415/129 |
| 2,253,406 | 8/1941 | Wagner | 416/186 A X |
| 2,360,571 | 10/1944 | Meehan | 416/168 R |
| 2,361,007 | 10/1944 | Buchanan . | |
| 2,378,580 | 6/1945 | Praüse et al. | 416/168 R |
| 3,090,543 | 5/1963 | Busquet | 416/186 A X |
| 3,782,853 | 1/1974 | Frister | 416/132 |
| 3,901,623 | 8/1975 | Grennan | 415/141 |
| 4,139,330 | 2/1979 | Neal | 416/87 |
| 4,177,007 | 12/1979 | Schlangen et al. | 415/160 |
| 4,412,783 | 11/1983 | Barlass | 416/186 A |

FOREIGN PATENT DOCUMENTS

| | | | |
|---|---|---|---|
| 1052818 | 3/1959 | Fed. Rep. of Germany | 416/186 A |
| 1107885 | 5/1961 | Fed. Rep. of Germany | 416/186 A |
| 1148127 | 12/1957 | France | 416/186 A |
| 1307113 | 9/1962 | France | 416/168 R |
| 737785 | 10/1955 | United Kingdom | 416/186 A |
| 165519 | 10/1964 | U.S.S.R. | 415/129 |

OTHER PUBLICATIONS

Westinghouse Airfoil Centrifugal Fans with Airfoil Blading catalog #1320 "New Design Ideas—from Holland", *Design News*, Jan. 19, 1959.

*Primary Examiner*—Everette A. Powell, Jr.
*Attorney, Agent, or Firm*—Ronald M. Anderson; William J. Beres; Robert J. Harter

[57] ABSTRACT

A centrifugal fan includes a fan wheel having airfoil blades mounted for pivotal movement about their center of gravity. A yoke mechanism exterior of the fan wheel, when moved axially of the fan wheel drive shaft axis, causes actuator rods to move through the sidewall of the fan wheel. The axial movement of the actuator rods is translated first into rotary movement of a quill hub relative to the fan wheel and finally to radial movement of blade pivoting levers interior of the fan wheel. The movement of the blade pivoting levers causes the pitch of the individual fan blades to be changed in accordance with the degree of movement of the yoke mechanism. The yoke mechanism, actuator rods, quill hub and blade pivoting levers operate independently of the fan wheel so that blade pitch can be varied over an operating range irrespective of whether the fan wheel is stopped or is rotating. The yoke mechanism is moved and fan modulation is accomplished in response to the demand for conditioned air by the variable air volume system in which the fan is employed.

19 Claims, 20 Drawing Figures

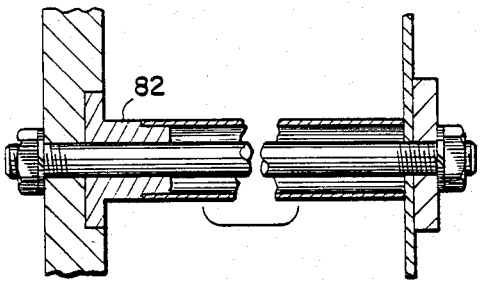
FIG. 15
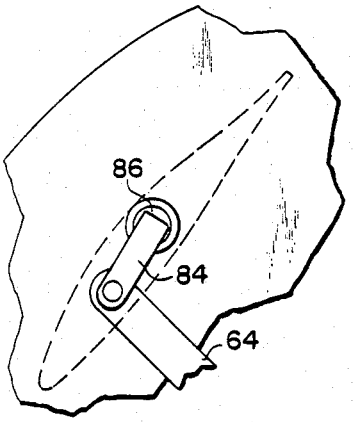
FIG. 17
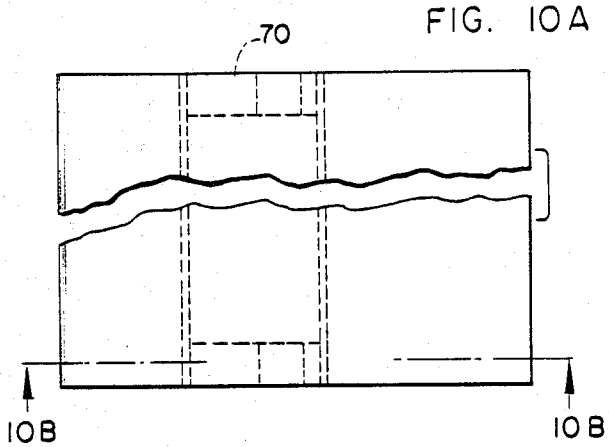
FIG. 10A
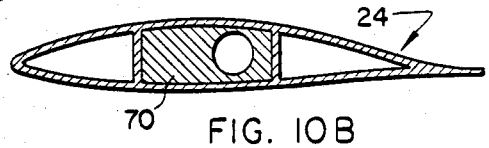
FIG. 10B
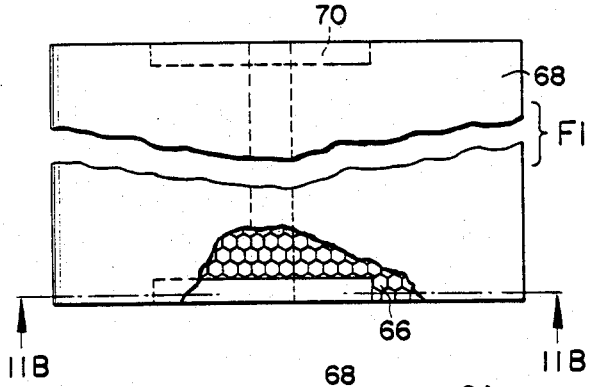
FIG. 11A
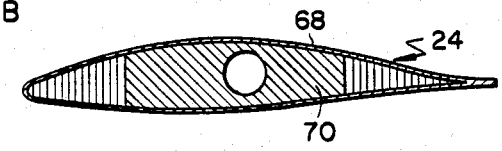
FIG. 11B
FIG. 18
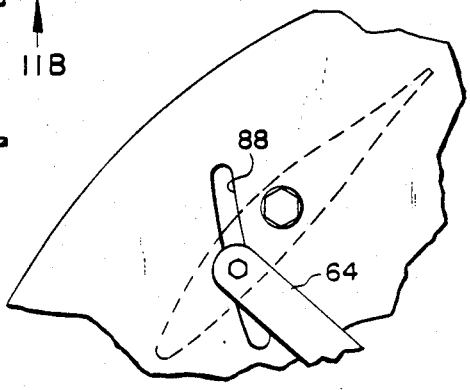

CENTRIFUGAL FAN WITH VARIABLE BLADE PITCH

BACKGROUND OF THE INVENTION

This invention relates to centrifugal fans and, more particularly, to a centrifugal fan having a mechanism for varying the pitch of the fan blades while the fan is in operation.

Variable air volume (VAV) systems are total building air conditioning supply systems which utilize a large central air-handling unit to deliver heated or cooled primary air to remote building locations. At each such remote building location a terminal box associated with a single room or space and responsive to the temperature in that room or space operates to vary the volume of conditioned air delivered to the space for temperature control purposes. By varying the volume of conditioned air supplied to each room in accordance with local demand conditions, as opposed to mixing both heated and cooled air to control individual room temperatures, significant energy savings are achieved by VAV systems. The large central air-handling unit at the core of a VAV system represents both a significant initial capital cost, and, due to its energy consumption, a primary operational cost to the building owner. As such, improvements in centrifugal fan technology whether relating to fan efficiency or initial cost represent meritorious and significant advances in the art.

Several modulation schemes exist by which the reduction and/or regulation of fan operation can be accomplished so as to reduce fan power consumption when load conditions allow. Among these fan modulations schemes are systems predicated on the use of: (1) discharge dampers, (2) inlet guide vanes, (3) eddy-current clutches, (4) variable speed belt drives, and (5) AC frequency inverters. All of the above-mentioned apparatus in some way relate to the control of a centrifugal fan so as to minimize power consumption by the fan motor. Several deal with the varying of fan speed in accordance with load conditions while others allow for fan operation at constant speeds but at reduced fan loads. The selection of a particular fan modulation scheme for use in a particular VAV application depends upon many factors. Among these factors are system size, fan and system operating conditions, load distribution, fan type (i.e., forward curved, backwardly inclined or airfoil blades), maintenance requirements and equipment space and cost.

The overall goal of fan modulation is to deliver only the required volume of conditioned air based upon local demand conditions for the lowest energy and initial investment costs. The favored and most economical fan modulation scheme when first cost is primarily considered, involves the use of inlet guide vanes on air handlers equipped with forward curved blades to regulate fan load. Inlet guide vane mechanisms, as best exemplified by U.S. Pat. No. 4,177,007 assigned to the assignee of the present invention, are relatively simple yet rugged and cost-efficient apparatus by which fan modulation can be accomplished. Inlet guide vanes modulate fan load by imparting a spin to the air delivered to the fan wheel in the direction of fan wheel rotation. The effect of this spin or pre-swirl is to cause the unloading of the fan blades which in turn decreases the volume of the air delivered by the fan. This, in turn, decreases the horsepower required to drive the fan wheel. While currently the fan modulation method of choice, inlet guide vanes do have drawbacks which detract from their efficiency and attractiveness for use. A primary disadvantage in the use of inlet guide vanes relates to their bulkiness and disposition near or in the inlet of a centrifugal fan. The location of inlet guide vanes at the fan inlet is an impediment to airflow at peak load conditions. At low load conditions, many inlet guide vane mechanisms are "leaky" and allow for the passage of a significant amount of unneeded air into the fan housing. This additional air only adds to the load on the fan yet does not serve any purpose with respect to building climate control. Further, the effect of inlet guide vanes on fan loading decreases as the demand for airflow decreases. Finally, while inlet guide vanes are relatively mechanically simple and reliable, such mechanisms are not integral with the centrifugal fan. That is, the blades and actuating mechanism for inlet guide vane assemblies often extend outward from the fan housing to the extent that they present fan mounting and installation difficulties, particularly in cramped fan rooms and spaces.

One approach to fan modulation, if successfully implemented as has not yet heretofore been accomplished, relates to varying the pitch angle or angle of attack of the fan blades of a centrifugal fan wheel while the fan is in operation. The blade pitch angle varying approach to fan modulation offers all of the advantages of inlet guide vanes while ameliorating some of their disadvantages. The superior power unloading characteristics of variable pitch fans is significant. As blade pitch angle increases in a variable pitch fan, the fan unloads due to a change in the aerodynamic characteristics of the fan wheel. As the fan unloads, a decrease in the volume of air delivered by the fan and of the static pressure of the system results in a corresponding drop in the horsepower required to drive the fan. Thus, in VAV systems fan performance can be optimally matched to system air volume and static pressure requirements so as to minimize system energy consumption at any given system load. Further, variable blade pitch fans offer effective modulation over a wider range of airflows than do inlet guide vane equipped fans. Finally, experiments indicate that variable blade pitch fans consume approximately one-third less energy in operation than do inlet guide vane equipped fans. Though the advantages of fan modulation by blade pitch variation have been recognized, no operable apparatus has been conceived by which the variance of blade pitch in a centrifugal fan is accomplished in a simple, inexpensive and reliable manner while the fan is in operation. In a VAV application wherein constant monitoring, response and control of a building's climate at discrete locations is required, the ability to vary the blade pitch of a centrifugal fan while the fan is in operation is a prerequisite to the use of such a fan modulation technique.

The primary reason for the lack of an operable centrifugal fan blade pitch varying scheme relates to the extremely high operating speeds and centrifugal forces developed on centrifugal fan blades while the fan is in operation. Such speeds and forces can approach 3,000 RPM and 2,400 G's in relatively large fans. A centrifugal fan and the forces developed thereon are entirely different from the forces developed in other types of fans such as vane axial fans. Further, the ability to modulate fan blade position in a centrifugal fan represents an entirely different design and manufacturing problem than the accomplishment of blade movement in a vane axial fan primarily because of the differences in blade location and attachment to the remainder of the rotating fan structure. Early attempts at blade pitch variation in centrifugal fans can be found in U.S. Pat. Nos. 509,143; 1,180,587; 2,361,007; and more recently, 4,139,330. These U.S. patents are to centrifugal fans or blowers which feature adjustable pitch blades. In all of these patents, however, blade pitch is preset while the fan is not operating and is not variable while the fan is in operation. Further, blade pitch in some of the patents noted above is variable only in a discrete stepwise fashion as opposed to variation of blade pitch to any angle over an entire operating range. Such schemes are thus entirely inappropriate for use in VAV systems wherein airflow and fan performance must be continuously monitored an modulated while the system is operating in order to maintain peak system energy efficiency.

Further, schemes are known by which a shape of a centrifugal fan blade is deformed or the position of a blade is affected by the centrifugal forces developed on such blades in operation so as to affect the flow of air into and through a centrifugal fan. Exemplary in this respect are U.S. Pat. Nos. 3,782,853 and 3,901,623. In both of these patents there is no positive control over blade position. Rather, blade position is merely a function of the centrifugal force acting on the blade at a particular fan wheel speed. Finally, the use of an adjustable trailing edge flap in conjunction with a fixed leading edge blade portion for fan modulation purposes is known. As has been specifically recognized, however, such flap actuating mechanisms are both complicated and costly and the forces acting on the trailing edge flap portions and the localized stresses which result are so high as to be unacceptable in high-speed centrifugal fan applications. Therefore, the need exists for apparatus by which the pitch of the blades of a centrifugal fan wheel can be varied such that acceptable stress levels and fan wheel rigidity are maintained in order to prevent unacceptable vibration and fan noise.

SUMMARY OF THE INVENTION

It is a primary object of this invention to provide a centrifugal fan having adjustable pitch fan blades.

It is a further object of this invention to provide centrifugal fan blade pitch varying apparatus which is operable to control fan blade pitch while the fan is in operation.

Another object of this invention is to provide a centrifugal fan construction which facilitates the employment of adjustable pitch fan blades.

Still another object of this invention is to provide a variable air volume system in which fan modulation is accomplished by varying the pitch of the blades of the air-handling unit from which conditioned air is provided to the system.

Finally, it is an object of this invention to provide a centrifugal fan having variable pitch blades which is of sufficient strength and rigidity such that acceptable noise and stress levels are maintained while the fan is in operation.

The objects of our invention as set forth above, together with objects of our invention which will become apparent upon reading the following description and claims in light of the attached Figures, are accomplished by a centrifugal fan having variable pitch blades which are positionable, while the fan is in operation, by apparatus which converts movement along the fan wheel axis to rotary and then radial movement by which fan blade pitch is varied.

The blade actuating apparatus of our invention consists of an axially movable yoke located and supported exterior of the fan housing and/or the fan wheel disposed therein. The yoke includes an outer non-rotating actuator ring and an inner rotating bearing holder between which a thrust bearing is disposed. The fan wheel drive shaft passes through the inner rotating bearing holder of the yoke mechanism but is not in contact with the bearing holder. Therefore, the yoke mechanism is axially movable with respect to and independent of the fan wheel drive shaft. Similarly, a rotatable drive ring is located interior of the fan wheel. The fan wheel drive shaft passes through but is not in contact with the rotatable drive ring. The drive ring has cam followers attached to it, the purpose of which will later be described.

The yoke mechanism and drive ring are connected for cooperative movement by a series of rods which are mounted parallel to the fan wheel drive shaft and which are attached to both the inner rotating bearing holder of the yoke mechanism and to the rotably mounted drive ring interior of the fan wheel. These rods pass through the sidewall of the fan wheel in sleeve or journal type bearings. Therefore, the rotation of the fan wheel carries the actuator rods which, in turn. causes the rotatable yoke mechanism bearing holder and the rotatable drive ring to rotate at fan speed.

Even at operational speeds, the actuator rods move easily through the sidewall of the fanwheel in response to axial movement of the yoke mechanism since the inner rotating bearing holder of the yoke mechanism, the fan wheel, the actuator rods and the drive ring all rotate at the same speed. Axial movement of the yoke mechanism and the axial movement of the drive ring which results therefrom causes an identical axial movement of the aforementioned cam followers attached to the drive ring. Also rotating with the fan wheel, interior of the fan wheel, is a quill hub mechanism. This hub is mounted for rotation both with the rotating fan wheel elements and further with respect to the fan wheel and the fan wheel drive shaft irrespective of whether or not the fan wheel is rotating. The quill hub defines bias cut slots in which the cam followers of the drive ring are trapped. Axial movement of the drive ring and, in turn, the cam followers attached to the drive ring, causes the rotation of the quill hub mechanism with respect to the fan wheel whether or not the fan wheel is rotating. Thus, axial movement of the cam followers in the bias cut slots of an already rotating quill hub imparts a further rotational movement to the quill hub which movement is relative to the remainder of the rotating fan wheel. The degree of rotational movement of the quill hub relative to the fan wheel is the same and corresponds directly to the degree of axial movement of the yoke mechanism independent of the rotational speed of the fan wheel. The fan wheel fan blades, each of which is capable of being rotated about an axis so as to vary the pitch of the blades within the fan wheel, are attached individually by levers to the quill hub mechanism. Axial movement of the cam followers and the resulting relative rotational movement of the quill hub with respect to the fan wheel therefore results in the movement of the levers and the rotation of each fan blade about its axis so as to vary the pitch of the blades within the fan wheel, even at operational speeds.

BRIEF DESCRIPTION OF THE DRAWINGS

FIGS. 10A, 10B, 11A and 11B illustrate airfoil blades of the type employed in the fan of the present invention.

FIGS. 12, 13, 14 and 15 are mounting arrangements for the pivotal fan blades of the fan of the present invention.

FIGS. 17 and 18 are alternative blade pivoting arrangements allowing for the location of the blade pivoting levers exterior of the fan wheel.

DESCRIPTION OF THE PREFERRED EMBODIMENT

Figure 2:
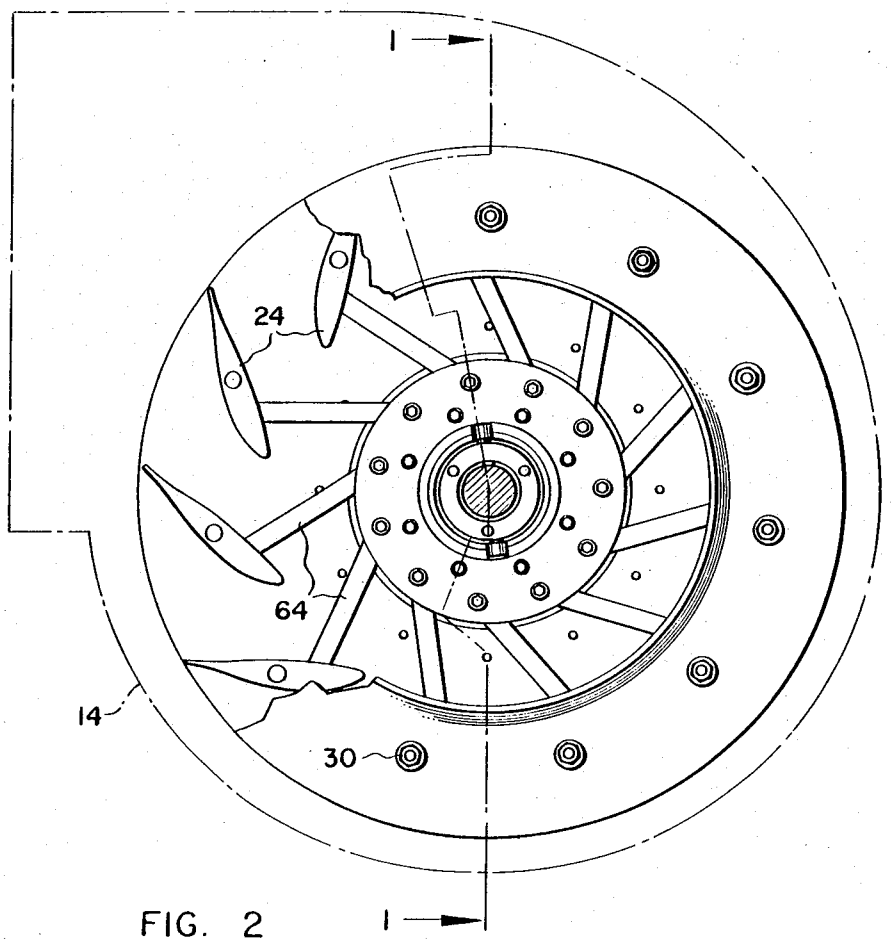
FIG. 2 is a partially broken-away side view of the fan wheel of the present invention.
Figure 1:
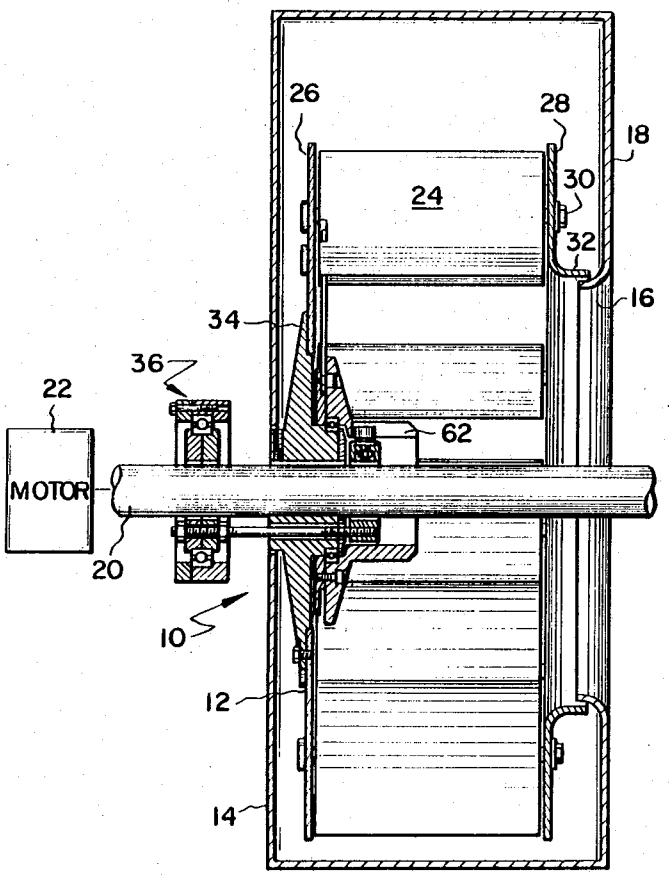
FIG. 1 is a cross-sectional view of the fan of the present invention taken along lines 1—1 of FIG. 2 with the fan blades in the open position.
Figure 4:
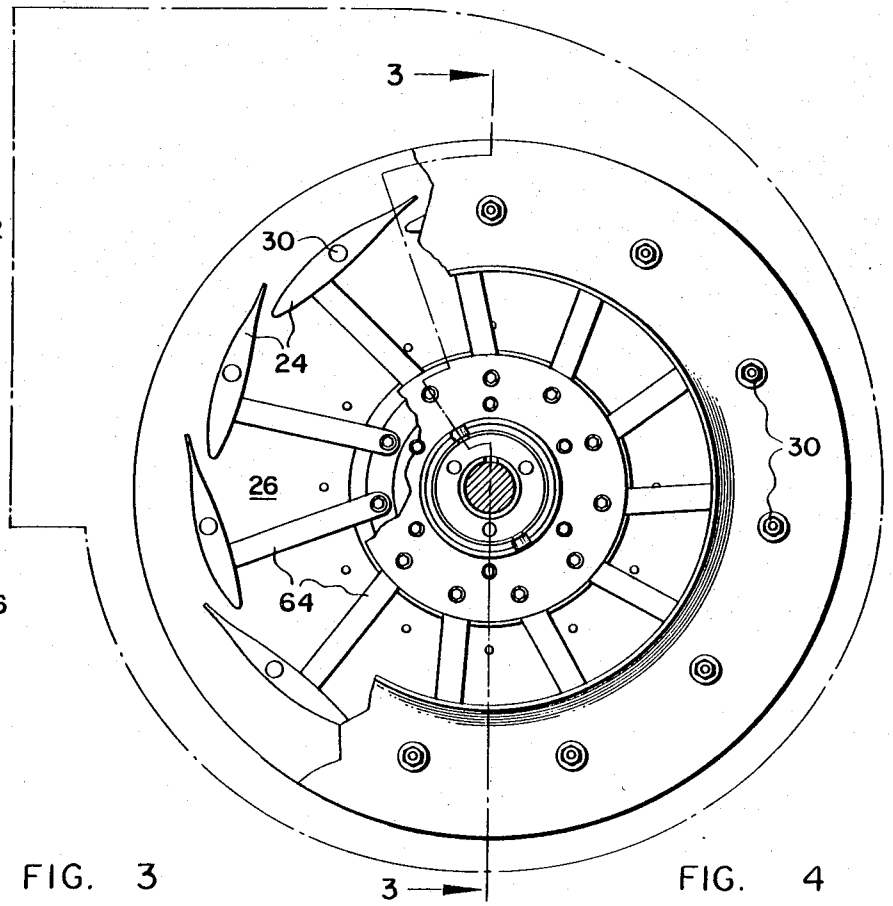
FIG. 4 is a paritially broken-away side view of the fan wheel of the present invention with the fan blades in the closed position.
Figure 3:
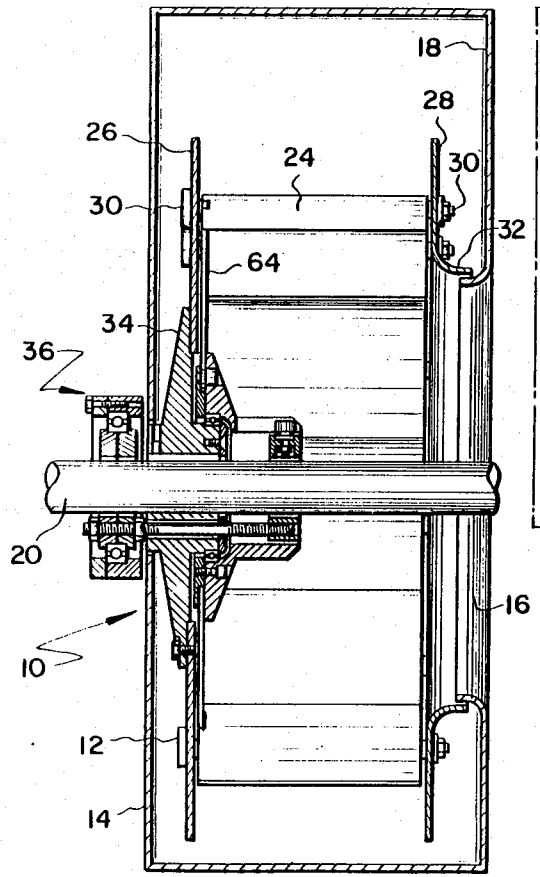
FIG. 3 is a cross-sectional view of the fan of the present invention taken along lines 3—3 of FIG. 4.

Referring initially to FIGS. 1–4, centrifugal fan 10 includes a fan wheel 12 mounted interior of a fan housing 14. Fan housing 14 defines an inlet 16 in sidewall 18 through which conditioned air enters the fan housing. As earlier mentioned, the more unobstructed opening 16 is, the more efficient is fan 10 at peak load conditions. Fan wheel 12 is rotatably mounted in fan housing 14 on drive shaft 20 which is driven by motor 22. Fan wheel 12 includes a plurality of fan blades 24 each of which is pivotally mounted for rotation between sidewalls 26 and 28 of the fan wheel. As is illustrated best in FIG. 3, fan blades 24 are rotatably mounted on blade pivot shafts 30 which pass through the center of gravity of each fan blade. Sidewall 28 of fan wheel 12 defines an inlet orifice ring 32 which cooperates with inlet 16 of fan housing 14 to define an efficient and essentially unobstructed passage through which air is delivered to the interior of the fan wheel. While fan housing 14 is illustrated as a scroll-type housing, the fan wheel and blade actuating apparatus of the present invention are likewise applicable to box or plug fan housings. Such housings, as their names imply, are essentially boxes in which centrifugal fan wheels are mounted and which are not conventional scroll housings. The centrifugal fan wheel is employed in such fans to cause a buildup of static pressure within the housing which is then employed in the delivery of air to a system.

Referring additionally now to FIGS. 5, 6, 7, 8 and 9, sidewall 26 of fan wheel 12 includes a mounting hub portion 34 which is mounted for rotation on and with drive shaft 20. Hub portion 34 supports fan wheel 12 within fan housing 14. Hub 34 is keyed to shaft 20 but many other types of mountings such as spline fits, shrink fits, or attachment by welding or brazing are conceivable. It will be evident therefore that when drive shaft 20 is caused to rotate by motor 22, mounting hub 34 will rotate as will fan wheel 12. Located exterior of fan wheel 12 and, in the preferred embodiment, exterior of fan housing 14 is a yoke mechanism 36. Yoke mechanism 36 includes a non-rotating actuator ring 38 and a rotating bearing holder 40. Bearing holder 40 is mounted for rotation within actuator ring 38 by means of a thrust bearing 42. A gap 44 exists between drive shaft 20 and bearing holder 40 so that, as will be apparent, there is no direct contact between drive shaft 20 and the yoke mechanism.

Figure 6:
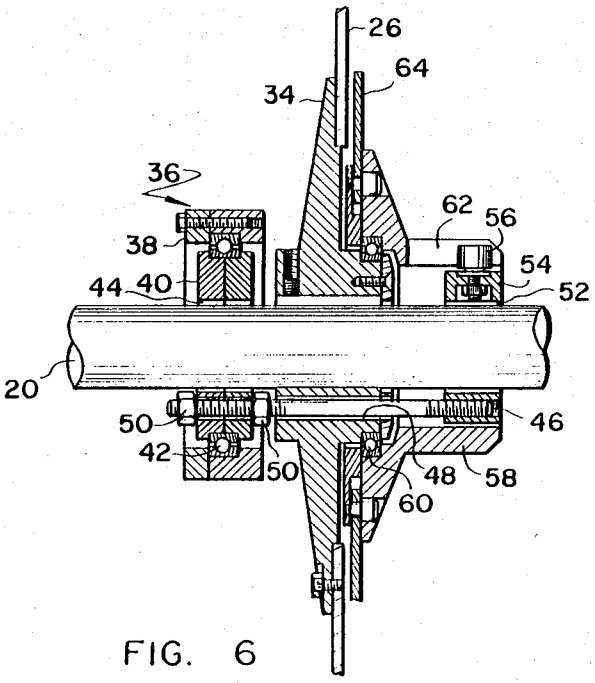
FIG. 6 is an enlarged cross-sectional view of the blade actuation apparatus for the position illustrated in FIG. 3 in which the fan blades are in the closed position.
Figure 5:
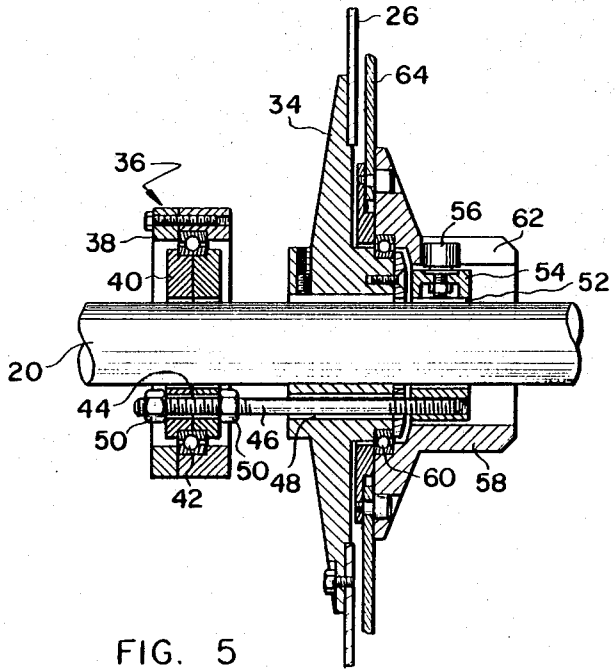
FIG. 5 is an enlarged cross-sectional view of the blade actuation apparatus for the position illustrated in FIG. 1 in which the fan blades are opened.

Passing through bearing holder 40 and through mounting hub 34 of fan wheel sidewall 26 are a plurality of actuator rods 46. Actuator rods 46 pass slidably through sleeve-type bearings 48, which are mounted in hub 34 of the fan wheel, and extend through the bearings into the interior of the fan wheel. The portions of rods 46 which are attached to bearing holder 40 of the yoke mechanism are prevented from moving with respect to bearing holder 40 such as by the arrangement as best illustrated in FIGS. 5 and 6 which show these portions being threaded and held in place by locking nuts 50. The portions of rods 46 which pass into the interior of the fan wheel extend into cooperating holes in a drive ring 54. The holes in drive ring 54 may be threaded and the portion of the rods 46 which extend interior of the fan wheel may be cooperatively threaded so that they may be threaded into the holes defined by the drive ring. Drive ring 54 has at least one and preferably two cam followers 56. As illustrated in FIGS. 5 and 6, a gap 52 exists between drive ring 54 and drive shaft 20 so as to permit drive ring 54 to move axially of shaft 20 without contacting it. As will be apparent and as will be further explained, the axial movement of yoke mechanism 36 causes rods 46 to move correspondingly through the sleeve bearings of mounting hub 34 and results in the identical axial movement of drive ring 54 and cam followers 56 interior of the fan wheel.

Figure 8:
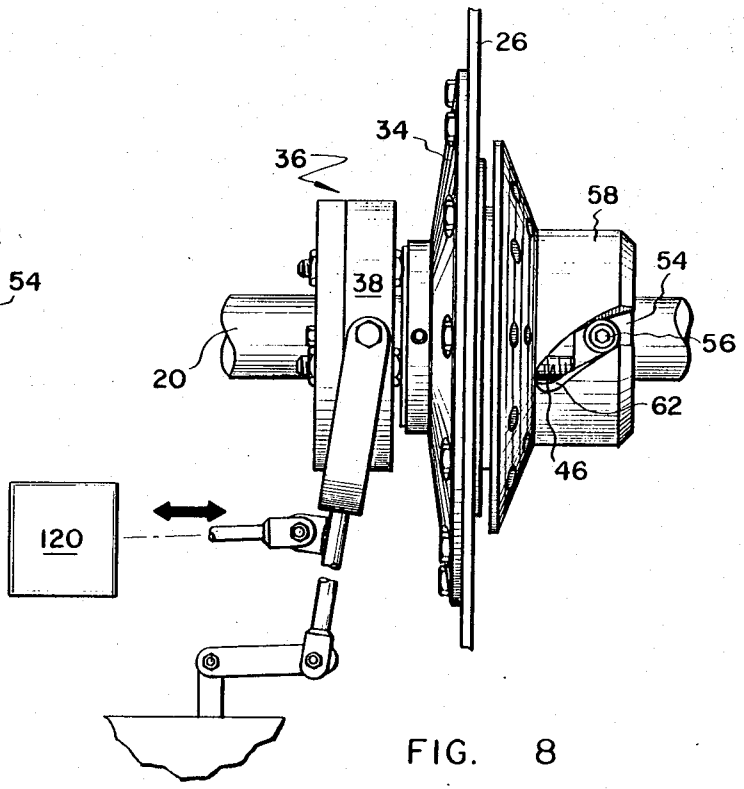
FIGS. 7 and 8 are perspective views of the blade actuating apparatus illustrated in FIGS. 5 and 6, respectively.
Figure 7:
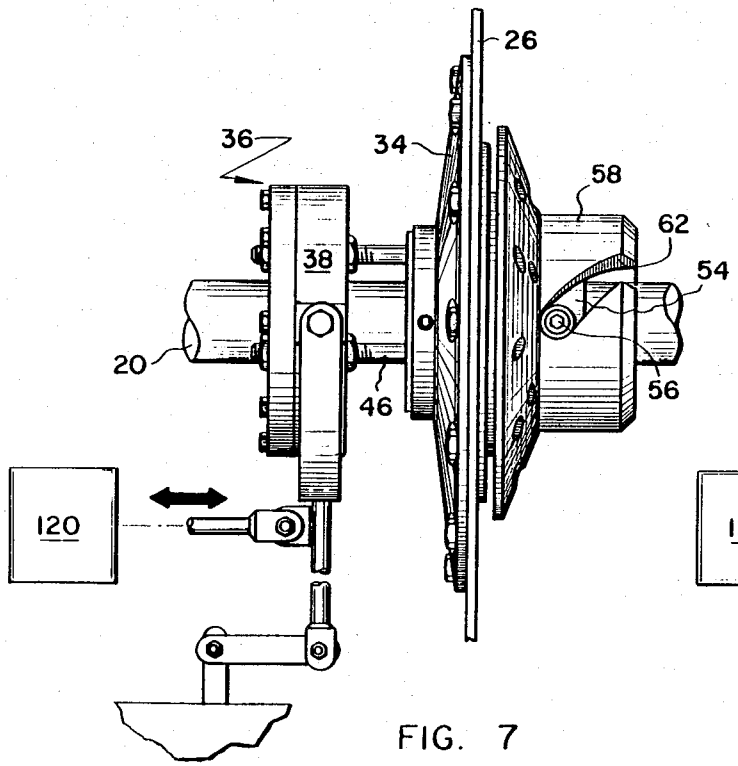
Figure 9:
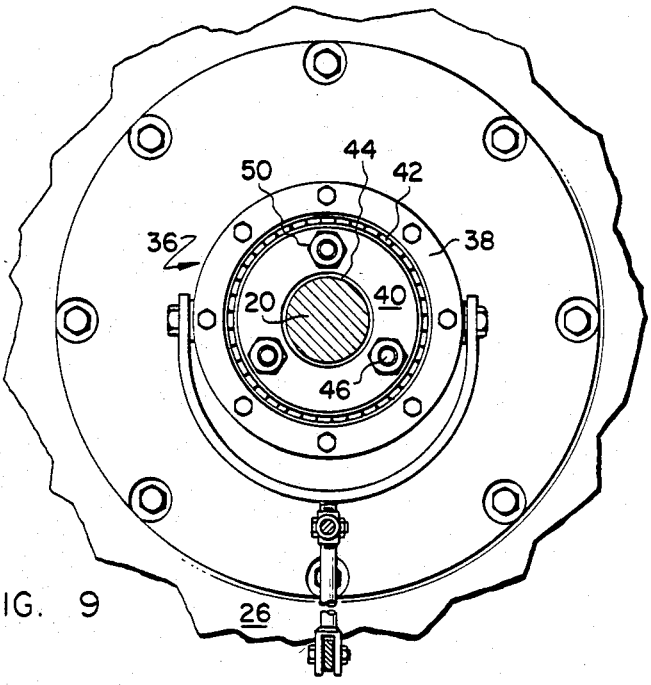
FIG. 9 is an end view of the yoke mechanism of the blade actuating apparatus of the present invention.

Rotatably supported within the interior of fan wheel 12 is a quill hub 58. As illustrated in FIG. 5, quill hub 58 is supported by roller bearing 60 which, in turn, is mounted on the mounting hub 34. As is best illustrated in FIGS. 7 and 8, quill hub 58 includes one slot cut on a bias for each cam follower of drive ring 54. Cam followers 56 are trapped in slots 62 and the axial movement of yoke mechanism 36 results in a corresponding axial movement of cam followers 56 which, in turn, causes the rotary movement of quill hub 58 on bearing 60 and with respect to fan wheel 12. It will be appreciated therefore that cam followers 56 can be characterized as quill hub actuators. Such rotary movement of quill hub 58 occurs easily and with little resistance because quill hub 58 is mounted on roller bearing 60. Referring to FIGS. 1–6, pivotally attached to quill hub 58 are actuator levers 64 which essentially are flat bar-like members which lie along the interior face of fan sidewall 26. Levers 64 are pivotally attached, one each, at one side of each fan blade 24 such that the rotation of quill hub 58 under the impetus of the axial movement of cam followers 56 causes fan blades 24 to pivot about their pivot axes as a result of the essentially radial movement of actuator levers 64. The pivot axis of each of fan blades 24 is preferably at the center of gravity of each fan blade and, when pivoted, the angle attack of the blades is changed around the center of gravity of each blade. Levers 64 do not interfere with airflow into and through the fan wheel and there is minimal windage loss and noise traceable to the blade actuator mechanism. The attachment of levers 64 to both quill hub 58 and to each of the fan blades is accomplished in a conventional manner such as by the use of screws, bolts, pins or any other form of attachment which will allow the levers to rotate about their point of attachment to both the quill hub and fan blades.

It should be appreciated that when motor 22 is energized, mounting hub 34 drives fan wheel 12 and that rods 46, bearing holder 40 of yoke mechanism 36, drive ring 54, cam followers 56, quill hub 58, levers 64 and blades 24 are also driven at the speed at which the fan rotates. Essentially, each of the elements thus far described other than fan housing 14 and actuator ring 38 of the yoke mechanism rotates at an identical speed when fan 10 is in operation. It will be seen then, particularly once steady-state operation is achieved, that there is little relative force acting on the rotating components of the fan when the fan is in operation. Therefore, even at speeds in excess of 2,000 RPM, when an axial force is applied to actuator ring 38 of yoke mechanism 36, there is little resistance to the slidable movement of actuator rods 46 through bearings 48 in mounting hub 34, which in turn causes the rotation of quill hub 58 relative to the fan wheel and the varying of blade pitch through the movement of levers 64.

The key feature of the actuator arrangement is the use of roller bearing 60 to rotatably support quill hub 58 for relative movement with hub 34. It should be apparent that in operation the inner race of ball bearing 60 rotates with mounting hub 34 at the speed at which the fan wheel is rotating. Further, as long as no rotational force is applied to quill hub 58 due to cam follower movement within the bias cut slots of the quill hub, there will be no relative movement of the outer race of bearing 60 with respect to the inner race of bearing 60 as both will be rotating at the same speed. That is, in steadystate operation while the fan and all of its components may be rotating at 2,000 RPM there is no relative movement between the rotating fan components. When an axial force is applied to the yoke mechanism and ultimately to cam followers 56 relative rotation does result, but only on the order of 20° or less, of the outer bearing race and quill hub with respect to the inner bearing race of bearing 60 and with respect to the sidewalls of the fan wheel. Similarly, the essentially radial movement of levers 64 which results from quill hub rotation is small and occurs only to the extent necessary to position fan blades 24 between the open position illustrated in FIG. 2 and the closed position illustrated in FIG. 4. Likewise, the axial movement required of yoke mechanism 36 in order to position blades 24 between the open and closed positions is small. The amount of movement of the yoke mechanism is illustrated graphically in FIGS. 1, 3, 7, and 8. The angle through which the blades are moved between the aforementioned open and closed positions is on the order of 15°–30°. It should be appreciated that the entirety of all of the relative movement of all of the components which move to cause fan blade rotation is extremely small and that the relative movement of such parts to cause fan blade rotation is identical whether the fan wheel is rotating or at rest within the fan housing. In an experimental 24" fan model, a one inch axial movement of the yoke mechanism results in the movement of the fan blades between their fully opened and closed positions.

Hollow extruded aluminum airfoil blades, as illustrated in FIGS. 10A and 10B, have proven to be the preferable form of fan blade for variable pitch centrifugal fan applications although properly designed blades of another type might be employed. The blades must be as low in weight as possible in order to minimize rotating loads yet must be rigid enough to withstand large bending stresses. Alternatively, blades 24 might be fabricated of thin guage metal formed over an expanded honeycomb core as illustrated in FIGS. 11A and 11B. Such blades, while more expensive, are ultralight and offer the requisite strength and rigidity for centrifugal fan applications. In the airfoil blades illustrates in FIGS. 11A and 11B honeycomb 66 is a metallic grid which is premachined to the airfoil shape. The metal airfoil skin 68 is attached to the honeycomb using any number of brazing or bonding techniques. End pieces 70 of the blades of both FIGS. 10 and 11 are likewise attached to the remainder of the airfoil blade by brazing or bonding. End pieces 70 perform a bushing function relating to blade mounting and movement. It is to be noted that an airfoil maximum thickness of from 5%–20% and preferably 9%–15% of airfoil chord length is advantageous. As the use of composite materials increases, the use of airfoil blades manufactured from such composite materials is foreseen.

The fan blades will be preferably mounted and pivoted about their center of gravity to facilitate blade support and rotation within the fan wheel. The shafts on which the blades pivot are fixedly mounted transversely between the sidewalls of the fan wheel to strengthen the fan wheel assembly and to make the whole assembly more rigid. Blades 24 will preferably be mounted on a shaft arrangement similar to one of those illustrated in FIGS. 12–15, all of which include a hollow fan blade mounting shaft. A hollow mounting shaft is preferable from the weight standpoint to reduce fan wheel stress in operation. As illustrated in FIGS. 12–15, the sidewall of the fan wheel which supports the weight of the fan wheel and which is called the "back plate", is thicker and stronger than the sidewall on the opposite side of the fan wheel. The fan wheel sidewall opposite the back plate which includes the orifice ring through which air enters the fan wheel is called the "shroud". Additionally, the figures illustrate that the fan wheel sidewalls are built up to strengthen them at blade pivot shaft attachment locations.

Figure 12:
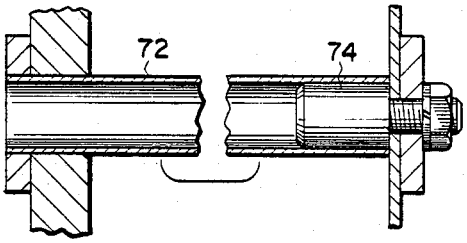
Figure 13:
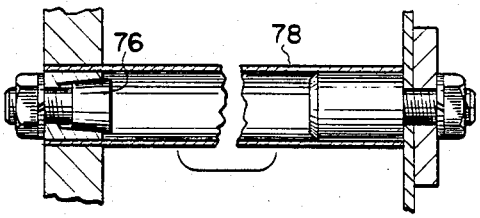
Figure 14:
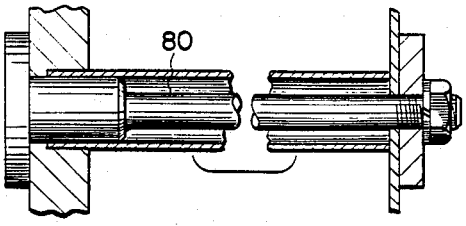

In the blade mounting arrangement of FIG. 12, a press or shrink-fit exists between shaft 72 and the back plate while a plug bolt 74 secures the opposite side of the hollow shaft to the fan wheel shroud. In the arrangement of FIG. 13, an expansion device 76 is used to achieve an interference fit between the back plate and the shaft 78. The hollow shaft could, of course, be welded or brazed to the back plate. The plug bolts illustrated in FIGS. 12 and 13 can also be brazed to the hollow blade mounting shafts. In the arrangement of FIG. 14, a tie-bolt 80 is used which provides for sufficient strength and rigidity without necessitating welding or brazing to be performed on the bolt. This precludes the possible distortion or other metallurgical problems associated with the welding or brazing of certain high tensile strength materials. A bolt is similiarly used in the arrangement of FIG. 15. While the diameter of the shaft of the tie-bolt in FIG. 14 is used to locate the hollow shaft on which the fan blades are mounted, a washer/bushing 82 is used in the arrangement of FIG. 15. All of the arrangements of FIGS.

12–15 illustrate a built-up portion welded to the fan wheel shroud so as to reduce stress in the vicinity of the shaft mounting holes which penetrate the shroud. It is further to be noted that at the cost of some expense, each blade might be mounted on its pivot shaft in a bearing arrangement which would further reduce the force necessary to rotate the blades while the fan is rotating. Finally, although blade actuator levers 64 are illustrated in the Figures as being attached to the blades on the leading edge side of each blade pivot axis, the levers might just as well be attached to the trailing edge side of the blades. The leading edge side of the blade offers a greater blade thickness at which the lever can be pivotally attached to the blade.

Figure 16:
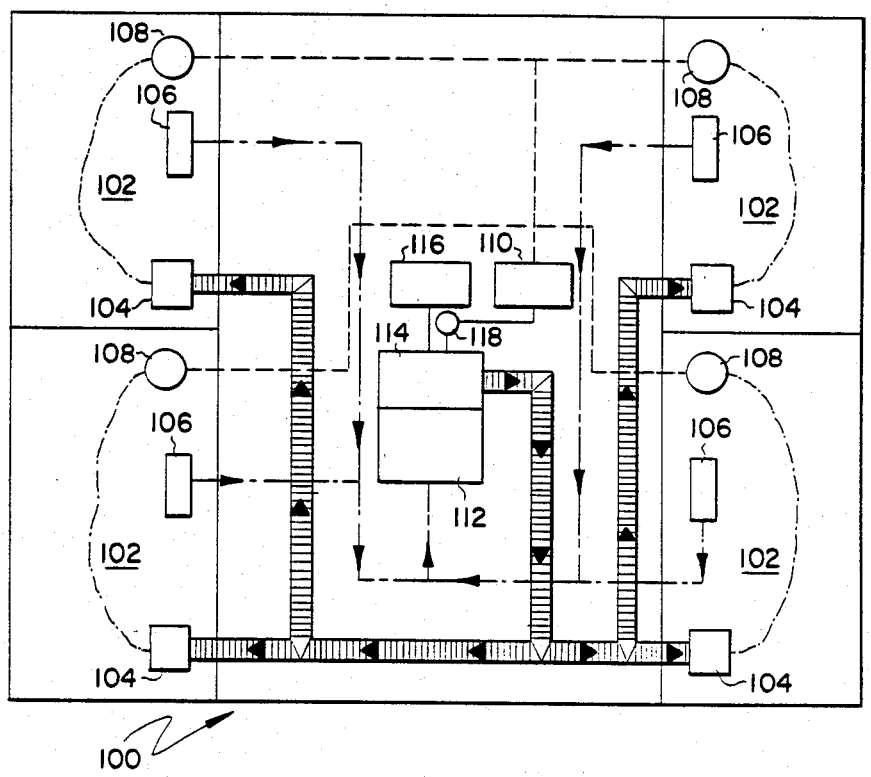
FIG. 16 schematically illustrates the variable air volume system of the present invention.

Referring now to FIG. 16, a variable air volume system is schematically illustrated. Building 100 has a plurality of spaces 102, each of which has a terminal air box 104 associated with it. Terminal air boxes 104 individually regulate the volume of conditioned air delivered to the space with which they are associated in accordance with the temperature of the air in the space. Each space 102 will likewise have a return air duct 106 and a sensor 108 which communicates the requirement for conditioned air in a particular space both to the terminal air box associated with that space and back to system controller 110. An air conditioner 112 is located in or exterior of building 100 the output of which is directed to centrifugal fan unit 114 having variable pitch blades and which is driven by motor 116. Air is returned to air conditioner 112 from each space 102 via return ducts 106.

In operation, sensors 108 sense the need for conditioned air in the spaces with which they are associated. This sensed need is communicated to the terminal air boxes 104 associated with each space and which are operable to vary the volume of air delivered to each space in accordance with the sensed needs of that space. Not shown are the terminal air heaters which may be employed and which are capable of supplying heated air to terminal boxes 104 which is then mixed with the conditioned air delivered from fan unit 114 to the terminal boxes in order to allow for the local warming of air delivered from the fan unit. The demand for conditioned air is sensed in each building space by sensors 108 and is communicated to system controller 110. System controller 110 includes apparatus for applying force to yoke mechanism 118 so as to modulate fan unit 114 in accordance with overall system demand for conditioned air. Yoke mechanism 118 operates on the variable pitch blades of fan unit 114 in accordance with the principles set forth above.

FIGS. 7 and 8 illustrate but one mechanical arrangement by which axial movement of the yoke mechanism 36 can be accomplished. Any method or apparatus by which force essentially axial of the drive shaft of the fan can be applied to non-rotating actuator ring 38 will suffice to cause the objects of this invention to be achieved. Ring 38 might be pneumatically, hydraulically or mechanically displaced, as by apparatus 120 illustrated in FIGS. 7 and 8. Further, it will be appreciated that the present invention is applicable to double-entry, double-width fan wheels. The yoke mechanism could be located in a space between the fan wheel sections, or alternatively, could be located outside and remote from one of the fan inlets. In any event, the axial movement of actuator rods could certainly extend through and be used to actuate more than the one set of fan blades of a single-width fan wheel.

Finally, it is recognized that the blade pitch varying apparatus of the present invention could be mounted exterior of the fan wheel in a mirror-image application of the apparatus illustrated in the figures. In such an application the quill hub, drive ring and levers would be located outside of the fan wheel between the mounting hub and the yoke mechanism. The only modifications required would be in the area of the fan blade locations. The fan blades would be fixedly mounted on the blade support shafts and the shafts would be rotatable within bearings or bushings in the fan wheel sidewalls. Referring to FIG. 17, an additional link 84 could be fixedly attached to the rotatable blade of mounting shaft 86 exterior of the sidewall of the fan wheel with the actuator lever 64 being pivotally connected to the end of fixed link 84 as well as to the quill hub. In this way, rotation of the quill hub would cause movement of the actuator lever which, in turn, would rotate the blade mounting shaft and the blade through the link fixedly attached to the shaft. Alternatively, levers 64 could be attached directly to the fan blades through bias cut slots 88 in a fan sidewall as illustrated in FIG. 18. In the embodiment of FIG. 18 the fan blades, as earlier described, would be rotatably mounted on non-rotating hollow support shafts.

What is claimed is:

1. A centrifugal fan comprising:

a fan housing having an inlet;

a centrifugal fan wheel mounted for rotation in said fan housing and having a first sidewall, a back plate and a plurality of fan blades, each of said fan blades being mounted for rotation about a pivot axis over a predetermined operating range of rotation, the degree of rotation of a fan blade about its pivot axis being determinative of the pitch of the blade in said fan wheel, said first sidewall defining an inlet cooperating with said fan housing inlet to provide a flow path for air into the interior of said fan wheel and said back plate defining a mounting surface;

a fan wheel driveshaft, said driveshaft penetrating and drivingly connected to said back plate so that driveshaft rotation causes the rotation of said fan wheel;

hub means, mounted on said back plate mounting surface, for rotation around said driveshaft irrespective of the rotational speed of said back plate or driveshaft, said hub means connected to said fan blades so that rotation of said hub means around said driveshaft causes the pitch of said fan blades to change;

a plurality of actuator rods penetrating and disposed for movement through said fan wheel back plate; and means for connecting said actuator rods to said hub means so that movement of said actuator rods through said back plate causes said hub means to rotate around said driveshaft.

2. The centrifugal fan according to claim 1 further comprising a yoke mechanism exterior of said fan wheel, said actuator rods connecting said yoke mechanism to said hub means through said means for connecting so that movement of said yoke mechanism axially of said driveshaft causes said actuator rods to move through said fan wheel back plate and results in the rotation of said hub means around said driveshaft.

3. The centrifugal fan according to claim 2 wherein said hub means is mounted interior of said fan wheel.

4. The centrifugal fan according to claim 3 wherein a portion of said yoke mechanism is rotatable and wherein said actuator rods are connected to said rotatable portion of said yoke mechanism, the rotation of said fan wheel causing the rotation, at fan wheel speed, of said actuator rods, said rotatable portion of said yoke mechanism and said means for connecting said actuator rods to said hub means.

5. The centrifugal fan according to claim 4 wherein said hub means is mounted on a bearing having an inner race and an outer race, the inner race of said bearing being fixedly mounted on said back plate mounting surface and wherein said yoke mechanism includes a non-rotatable portion, said yoke mechanism, said actuator rods and said means for connecting said actuator rods to said hub means all moving axially of the axis of rotation of said fan wheel in response to the application of force axially of said driveshaft to the non-rotatable portion of said yoke mechanism.

6. The centrifugal fan according to claim 5 further comprising means for translating the axial movement of said means for connecting said actuator rods to said hub means into rotational movement of said hub means relative to said driveshaft.

7. The centrifugal fan according to claim 6 wherein said hub means defines a bias cut slot and wherein said means for connecting said acutator rods to said hub means comprises a drive ring fixedly attached to said actuator rods and having a cam follower, said cam follower being trapped in said bias cut slot of said hub means so that movement of said cam follower in said slot causes said hub means to rotate with respect to said driveshaft irrespective of the rotational speed of said driveshaft.

8. The centrifugal fan according to claim 7 wherein said fan blades are mounted for rotation on hollow pivot shafts mounted transversely between said first sidewall and said back plate.

9. The centrifugal fan according to claim 8 wherein said fan blades are hollow.

10. The centrifugal fan according to claim 9 wherein the thickness of said fan blades is in a range of from 9 to 15 percent of the chord length of said blades.

11. Apparatus for varying the pitch of the blades of a centrifugal fan comprising:

a centrifugal fan wheel mounted for rotation on a driveshaft, said fan wheel having a back plate, a sidewall defining an inlet and a plurality of fan blades each mounted for rotation about a pivot axis;

hub means mounted on said back plate for rotational movement relative to said fan wheel back plate and around said driveshaft irrespective of whether said fan wheel and driveshaft are at rest or are rotating;

means for causing said fan blades to rotate in response to the rotational movement of said hub means relative to said fan wheel back plate;

a plurality of actuator rods spaced around and parallel to said driveshaft, said actuator rods carried by and slidably penetrating said back plate for movement therethrough;

ring means penetrated by and spaced from said driveshaft, said ring means being fixedly connected to the ends of said actuator rods on one side of said back plate;

means for connecting said ring means to said hub means so that movement of said ring means axially of said driveshaft, in response to movement of said actuator rods through said back plate, causes said hub means to rotate; and yoke means having a rotatable portion attached to the ends of said actuator rods opposite the ends attached to said ring means, said rotatable portion of said yoke means being penetrated by and spaced from said driveshaft, whereby said fan wheel, said hub means, said means for causing said blades to rotate, said actuator rods, said ring means, said means for connecting and said rotatable portion of said yoke means are all driven at the rotational speed of said driveshaft and whereby movement of said yoke means axially of said driveshaft causes said hub means to rotate around said driveshaft, independent of the rotational speed of said driveshaft, thereby causing the rotation of said fan blades about their pivot axes to a degree which is predetermined and independent of fan wheel speed.

12. The apparatus according to claim 11 wherein said hub means is mounted interior of said fan wheel.

13. The apparatus according to claim 12 wherein said hub means is mounted for rotation on the outer race of a ball bearing, the inner race of said ball bearing being mounted on a portion of said fan wheel back plate, and wherein said means for connecting comprises at least one cam follower fixedly attached to said ring means, said at least one cam follower being disposed in a bias cut slot in said hub means so that movement of said ring means axially of said driveshaft causes said hub means to rotate around said driveshaft and relative to said fan wheel back plate.

14. The apparatus according to claim 13 wherein said fan blades are airfoil shaped and are mounted for rotation about their center of gravity, said means for causing said fan blades to rotate comprising a plurality of levers pivotally connected to both said hub means and to each of said blades.

15. The apparatus according to claim 14 wherein said blades are mounted on hollow pivot shafts, said pivot shafts being mounted transversely in said fan wheel.

16. The apparatus according to claim 1 wherein said inlet defined by said first fan wheel sidewall and said fan housing inlet is unobstructed by any of said hub means, said actuator rods and said means for connecting.

17. The apparatus according to claim 1 wherein said actuator rods are individually carried in sleeve bearings in said back plate and are equally spaced around said driveshaft.

18. The apparatus according to claim 12 wherein said sidewall inlet is entirely unobstructed by said apparatus for varying the pitch of the blades.

19. The apparatus according to claim 12 wherein said actuator rods are individually carried in sleeve bearings in said back plate and are equally spaced around said driveshaft.

* * * * *